US011351691B2

(12) United States Patent
Capoia

(10) Patent No.: US 11,351,691 B2
(45) Date of Patent: Jun. 7, 2022

(54) MACHINE AND METHOD FOR WORKING A MATERIAL SUITABLE TO MAKE CONTAINERS

(71) Applicant: PANOTEC S.R.L., Cimadolmo (IT)

(72) Inventor: Giuseppe Capoia, Cimadolmo (IT)

(73) Assignee: PANOTEC S.R.L., Cimadolmo (IT)

( * ) Notice: Subject to any disclaimer, the term of this patent is extended or adjusted under 35 U.S.C. 154(b) by 0 days.

(21) Appl. No.: 16/082,248

(22) PCT Filed: Mar. 11, 2016

(86) PCT No.: PCT/IT2016/000065
§ 371 (c)(1),
(2) Date: Sep. 4, 2018

(87) PCT Pub. No.: WO2017/154028
PCT Pub. Date: Sep. 14, 2017

(65) Prior Publication Data

US 2019/0039256 A1 Feb. 7, 2019

(51) Int. Cl.
*B26D 1/18* (2006.01)
*B26D 1/22* (2006.01)
(Continued)

(52) U.S. Cl.
CPC ..... *B26D 1/185* (2013.01); *B26D 1/225* (2013.01); *B26D 7/2635* (2013.01);
(Continued)

(58) Field of Classification Search
CPC ..... B26D 1/185; B26D 1/225; B26D 7/2635; B26D 2007/0093; B26D 2007/2657; B31B 50/146; B31B 50/256; B31F 1/10
See application file for complete search history.

(56) References Cited

U.S. PATENT DOCUMENTS 4,540,394 A * 9/1985 Cavagna ..... B26D 5/04 493/365
4,684,360 A * 8/1987 Tokuno ..... B26D 7/2635 493/365

(Continued)

FOREIGN PATENT DOCUMENTS

EP 1 577 052 A2 9/2005
WO WO 00/21713 A1 4/2000

(Continued)

OTHER PUBLICATIONS

International Search Report (PCT/ISA/210) issued in PCT/IT2016/000065, dated Dec. 16, 2016.

(Continued)

*Primary Examiner* — Nathaniel C Chukwurah
*Assistant Examiner* — Lucas E. A. Palmer
(74) *Attorney, Agent, or Firm* — Birch, Stewart, Kolasch & Birch, LLP

(57) ABSTRACT

A machine and a method to carry out workings on a sheet of a sufficiently rigid material is suitable to make containers. The machine includes a transverse working head guided by a first transverse guide member, one or more longitudinal working heads, each selectively positionable in a desired transverse position, guided by at least a second transverse guide member parallel to the first transverse guide member; and positioning mechanism configured to cooperate with each longitudinal working head in order to selectively position it in the desired transverse position.

18 Claims, 5 Drawing Sheets

(51) Int. Cl.

| | |
|---|---|
| ***B26D 7/26*** | (2006.01) |
| ***B31F 1/10*** | (2006.01) |
| ***B31B 50/14*** | (2017.01) |
| *B26D 7/00* | (2006.01) |
| *B31B 50/25* | (2017.01) |

(52) U.S. Cl.
CPC ..... *B31B 50/146* (2017.08); *B31F 1/10* (2013.01); *B26D 2007/0093* (2013.01); *B26D 2007/2657* (2013.01); *B31B 50/256* (2017.08)

(56) References Cited

U.S. PATENT DOCUMENTS 5,183,672 A * 2/1993 Fetterhoff ..... B29C 53/06 264/284
5,321,892 A * 6/1994 Sasada ..... B26D 1/185 33/18.1
5,624,369 A * 4/1997 Bidlack ..... B31B 50/00 493/342
5,638,732 A * 6/1997 Becker ..... B23D 57/0007 83/461
5,964,686 A * 10/1999 Bidlack ..... B26D 1/185 493/160
6,245,004 B1 * 6/2001 Waters ..... B26F 1/3813 493/473
6,286,404 B1 * 9/2001 Miglietta ..... B26D 7/2635 83/498
2004/0082453 A1 * 4/2004 Pettersson ..... G05B 19/19 493/180
2009/0071305 A1 * 3/2009 Myers ..... D06H 7/02 83/156
2012/0115699 A1 * 5/2012 Capoia ..... B26D 7/2635 493/324
2013/0036884 A1 * 2/2013 Schurch ..... B31B 50/74 83/37
2013/0045847 A1 * 2/2013 Capoia ..... B26D 7/2635 493/59
2014/0018225 A1 * 1/2014 Capoia ..... B31F 1/10 493/405
2014/0315701 A1 * 10/2014 Pettersson ..... B31B 50/14 493/56
2016/0185065 A1 * 6/2016 Sytema ..... B31B 50/52 493/180
2016/0185475 A1 * 6/2016 Pettersson ..... B65B 11/004 53/493

FOREIGN PATENT DOCUMENTS

WO WO 2005/009697 A1 2/2005
WO WO 2011/135433 A1 11/2011

OTHER PUBLICATIONS

Written Opinion (PCT/ISA/237) issued in PCT/IT2016/000065, dated Dec. 16, 2016.

* cited by examiner

MACHINE AND METHOD FOR WORKING A MATERIAL SUITABLE TO MAKE CONTAINERS

FIELD OF THE INVENTION

The field of application of the present invention concerns machines and methods for working a sufficiently rigid, smooth or corrugated material, such as for example paper, cardboard, plastic material or other suitable materials to make containers, for example for packaging, such as boxes, either small or large, even more than a meter per side. In particular, such methods comprise at least some of the following steps: cutting, creasing, continuous and/or in segments, pre-creasing and punching, using a plurality of tools positionable with respect to a fixed frame of the machine, as a function of the sizes and of the type of container to be made. With the machine and the method of the present invention a shaped flat product can be obtained, which represents the development of the container to be made, or at least a part of it, ready to be subsequently folded to form the container itself in three-dimensional form.

BACKGROUND OF THE INVENTION

In the field of machines and methods to make products for packaging, it is known to carry out a plurality of workings with the same machine on a sufficiently rigid material, for example a sheet of cardboard, intended in the present description and the claims either as a single sheet with a determinate thickness and determinate lateral size, or as a sheet coming from a roll or from a strip which is subsequently cut to size. These workings typically comprise cutting and creasing, sometimes preceded by pre-creasing. In some machines a punching operation is also optionally carried out.

In particular, from the international patent application WO-A-201 1/135433, in the name of the Applicant, a machine is known to make containers by means of cutting and/or creasing operations, on a sheet of sufficiently rigid material. The known machine comprises a fixed frame with lateral flanks and two transverse guide bars perpendicular to them; feed rolls able to feed the sheet to be worked on a horizontal plane, in a longitudinal direction, parallel to the lateral flanks; a transverse working head, mobile along one of the two transverse guide bars in a transverse direction perpendicular to the longitudinal direction, in order to carry out transverse cuts and/or creasings on the sheet. In the known machine numerous longitudinal working heads are also present, each of which is mobile along the other of the two transverse guide bars in order to be positioned selectively in the transverse direction, to carry out longitudinal cuts and/or creasings on the sheet, in addition to or alternatively to the transverse ones. A positioning device is mounted on the transverse working head and is able to cooperate with each longitudinal working head in order to position it selectively in the desired work position in the transverse direction. In this way, each longitudinal working head is selectively positionable in a desired transverse work position, also different from the one before, whenever it is necessary to set the machine to make a different container from the one produced before.

The known machine described above has the disadvantage, however, that the single transverse guide bar that supports all the different longitudinal working heads does not guarantee a stable and precise positioning of each of them in the transverse direction, nor does it guarantee a reliable clamping of each of them in the work position reached.

One purpose of the present invention is to design a machine and perfect a method to work a sufficiently rigid material, suitable to make containers, that are very reliable and that guarantee a precise and secure guide for each of the numerous longitudinal working heads.

Another purpose of the present invention is to design a machine to work a sufficiently rigid material, suitable to make containers, that allows to selectively position each of the numerous longitudinal working heads in a desired transverse position, even while the transverse working head is operating and carrying out the transverse workings on the sheet being worked, to thus reduce the preparation times of the machine and production time in its entirety.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a machine for working a sheet of a sufficiently rigid material, suitable to make containers, according to the present invention, comprises a fixed frame that defines a support plane for the sheet and feed means, configured to feed the sheet in a first longitudinal direction along the support plane, wherein the fixed frame comprises at least a first transverse guide member disposed in a transverse direction, substantially perpendicular to the first longitudinal direction. The machine also comprises: a transverse working head, provided with a first cutting tool and/or a first creasing tool and guided by said first transverse guide member, to selectively carry out transverse cuttings and/or creasings on the sheet; one or more longitudinal working heads, each provided with a second cutting tool and/or a second creasing tool to selectively carry out longitudinal cuttings and/or creasings on the sheet, and each selectively positionable in a desired transverse position, guided by at least a second transverse guide member parallel to the first transverse guide member, to carry out longitudinal cuttings and/or creasings on the sheet; and positioning means, configured to cooperate with each longitudinal working head in order to position it selectively in the desired transverse position.

In accordance with one aspect of the present invention, the positioning means comprise a first transverse positioning device mounted on the transverse working head, and a second transverse positioning device mounted on the fixed frame and each configured to position each of the longitudinal working heads in the transverse direction.

This solution allows to optimize the positioning modes of the longitudinal working heads also during the working operations, in which the transverse working head is working and would not allow the positioning operations.

In this way it is possible to optimize the working processes of a machine, completely eliminating the downtimes due for example to the setting of the machine required for a change of shape of the product to be obtained.

In accordance with another aspect of the present invention, each longitudinal working head is disposed between the first transverse guide member and the second transverse guide member, and comprises sliding elements configured to cooperate slidingly with both the first transverse guide member and the second transverse guide member.

In accordance with another aspect of the present invention, the first transverse guide member comprises a first pair of guide rails distanced vertically so as to cooperate one with an upper part of a first slider of the transverse working head and another with a lower part of the first slider.

In accordance with another aspect of the present invention, the first transverse guide member also comprises a second pair of guide rails distanced vertically so as to cooperate one with an upper part of a second slider of a corresponding longitudinal working head and another with a lower part of the second slider.

In accordance with another aspect of the present invention, the first transverse guide member comprises a bar with two vertical lateral surfaces, on a first of which the first pair of guide rails is attached, while the second pair of guide rails is attached on a second vertical lateral surface.

In accordance with another aspect of the present invention, the second transverse guide member comprises a third pair of guide rails, which are aligned vertically with the second pair of guide rails, in order to also cooperate one with an upper part of the second slider and another with a lower part of the same second slider, but on the opposite side of the latter with respect to the second pair of guide rails.

In accordance with another aspect of the present invention, the second slider is provided with a clamping device, configured to selectively clamp the corresponding longitudinal working head in the desired transverse position, with respect to at least one of the transverse guide members.

In accordance with another aspect of the present invention, the method to make workings on a sheet of a sufficiently rigid material, suitable to make containers, comprises: a step in which the sheet is fed in a first longitudinal direction; a step in which transverse cuts and/or creasings are carried out by means of a transverse working head, provided with a first cutting tool and/or a first creasing tool, and mobile in a second transverse direction, substantially perpendicular to the first longitudinal direction; a step in which longitudinal cuts and/or creasings are carried out by means of one or more longitudinal working heads each provided with a second cutting tool and/or a second creasing tool and each selectively positionable in a desired position in the second transverse direction. In accordance with another characteristic aspect of the present invention, each longitudinal working head is selectively positioned in the desired transverse position by means of a first positioning device, mounted on the transverse working head, or by means of a second positioning device mounted on the fixed frame of the machine and drivable even while the transverse working head is carrying out the transverse cuts and/or the transverse creasings.

According to a possible solution, the selective positioning in a desired position in the second transverse direction is preceded by a setting step in which, by means for example of the control and command unit, the method determines which of either the first positioning device or the second positioning device to drive, in order to position each longitudinal working head.

BRIEF DESCRIPTION OF THE DRAWINGS

These and other characteristics of the present invention will become apparent from the following description of a preferred embodiment, given as a non-restrictive example with reference to the attached drawings wherein.

DETAILED DESCRIPTION OF ONE EMBODIMENT OF THE PRESENT INVENTION

Figure 1:
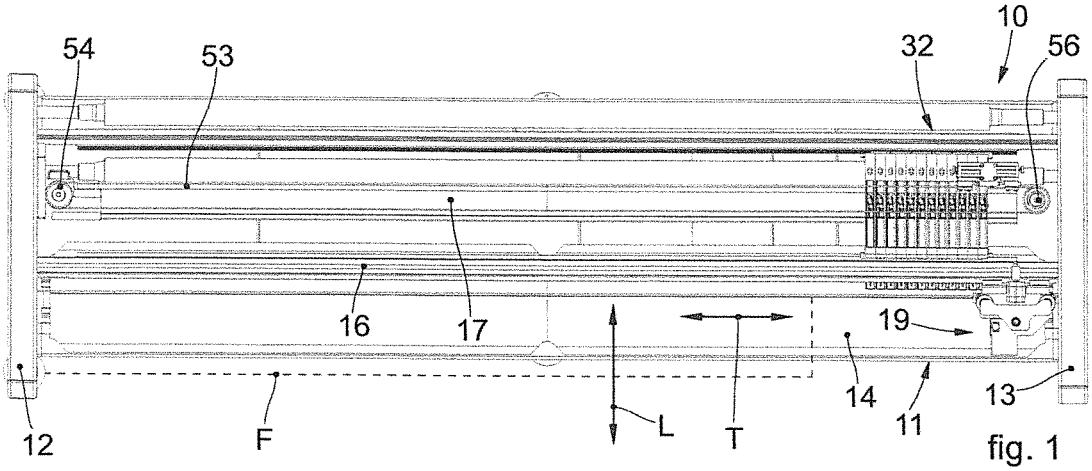
FIG. 1 is a plan view of a machine according to the present invention for working sufficiently rigid material suitable to make containers.
Figure 5:
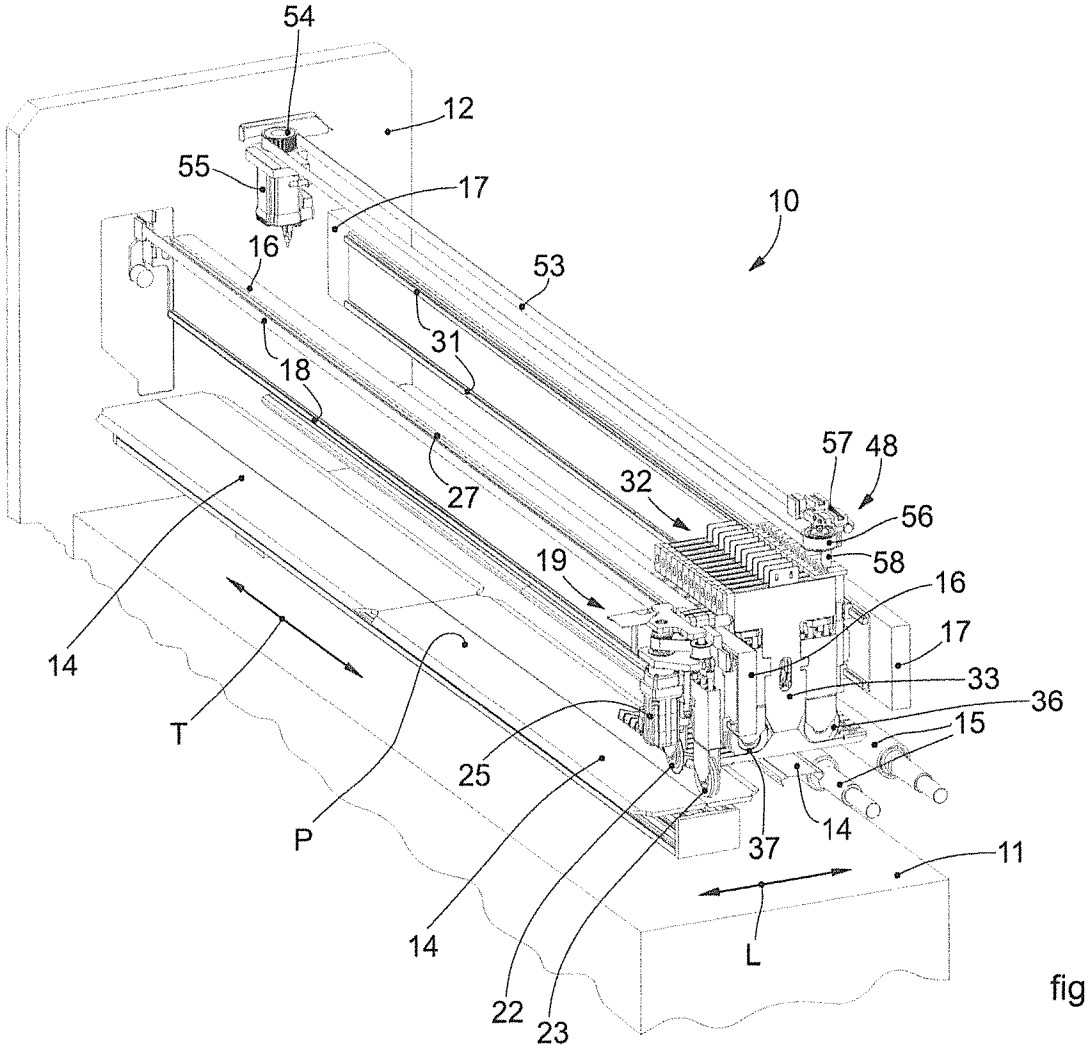
FIG. 5 is a three-dimensional view, front right, of a part of the machine in FIG. 1.

With reference to FIG. 1, a machine 10 according to the present invention, to make containers, for example boxes for packaging, starting from a flat sheet F of sufficiently rigid material, such as for example paper, cardboard, plastic material or other suitable materials, comprises a fixed frame 11, with two vertical lateral flanks 12 and 13, between which horizontal plates 14 are disposed (FIGS. 5, 6 and 7) that define a support plane P (FIG. 7), suitable to support the sheet F during the working thereof.

Four feed rolls 15 are mounted rotatable on the vertical lateral flanks 12 and 13, configured to selectively feed the sheet F in a longitudinal direction L parallel to the vertical lateral flanks 12 and 13.

In the embodiment shown here, the gap between the vertical lateral flanks 12 and 13 is such as to also allow several sheets F to be inserted coplanar with respect to each other, one alongside the other, in order to be worked at the same time.

Merely by way of example the gap between the vertical lateral flanks 12 and 13 can be comprised between 600 mm and 4000 mm, depending on the specific application of the machine. Merely by way of example, machines can be provided with a gap between the vertical lateral flanks 12 and 13 of about 880 mm, about 2500 mm and about 3000 mm.

On the vertical lateral flanks 12 and 13, above the feed rolls 15, a first and a second transverse guide member are attached, in this case a first transverse guide bar 16 (FIGS. 5, 6 and 7) and a second transverse guide bar 17, parallel to each other, perpendicular to the longitudinal direction L and each with a substantially rectangular cross section, with the larger sides vertical.

Figure 7:
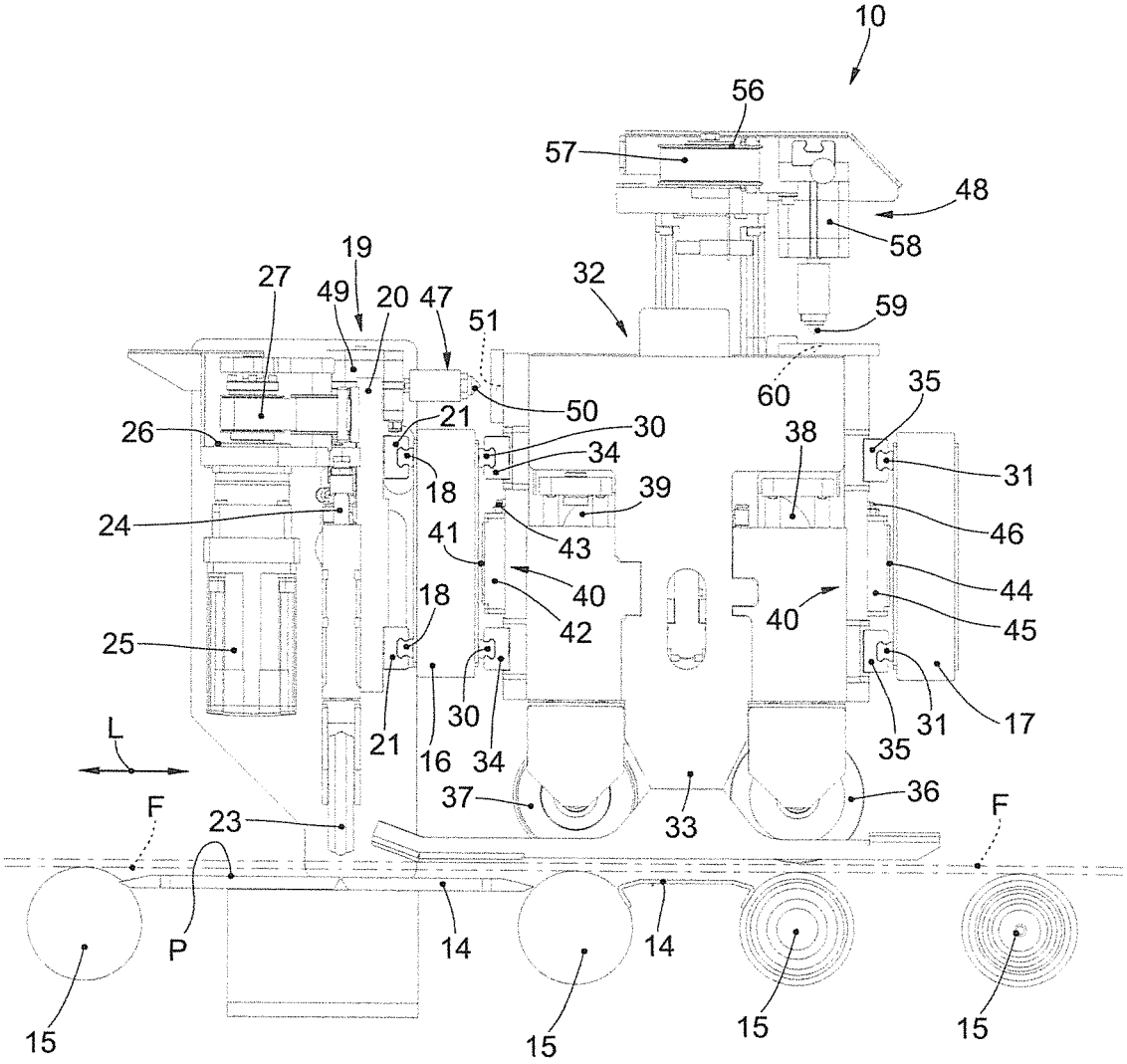
FIG. 7 is a right lateral view of a part of the machine of FIG. 1 on an enlarged scale.

On the front side of the first transverse guide bar 16 (on the left in FIG. 5) two first guide rails 18 are mounted, on which a transverse working head 19 is mounted sliding, in a transverse direction T (FIGS. 1 and 5), perpendicular to the longitudinal direction L and comprises a slider 20 provided with sliding pads 21 (FIG. 7).

The vertical distance between the two first guide rails 18 is sufficiently large, for example comprised between 150 mm and 300 mm, so that the two guide rails 18 are one in correspondence with the upper part of the slider 20 and the other in correspondence with the lower part of the same slider 20, in order to guarantee a secure and stable guide of the latter when it moves in the transverse direction T.

A cutting tool 22 (FIG. 6) consisting of a circular blade, and a creasing tool 23 consisting of a shaped disc, are mounted on the slider 20. The tools 22 and 23 are connected, in a known manner, to corresponding actuators 24, for example pneumatic, configured to take them selectively against each sheet F below, in order to make transverse cuts and/or creasings, when the sheet F is stopped and the slider 20 moves with respect to it in the transverse direction T.

Figure 2:
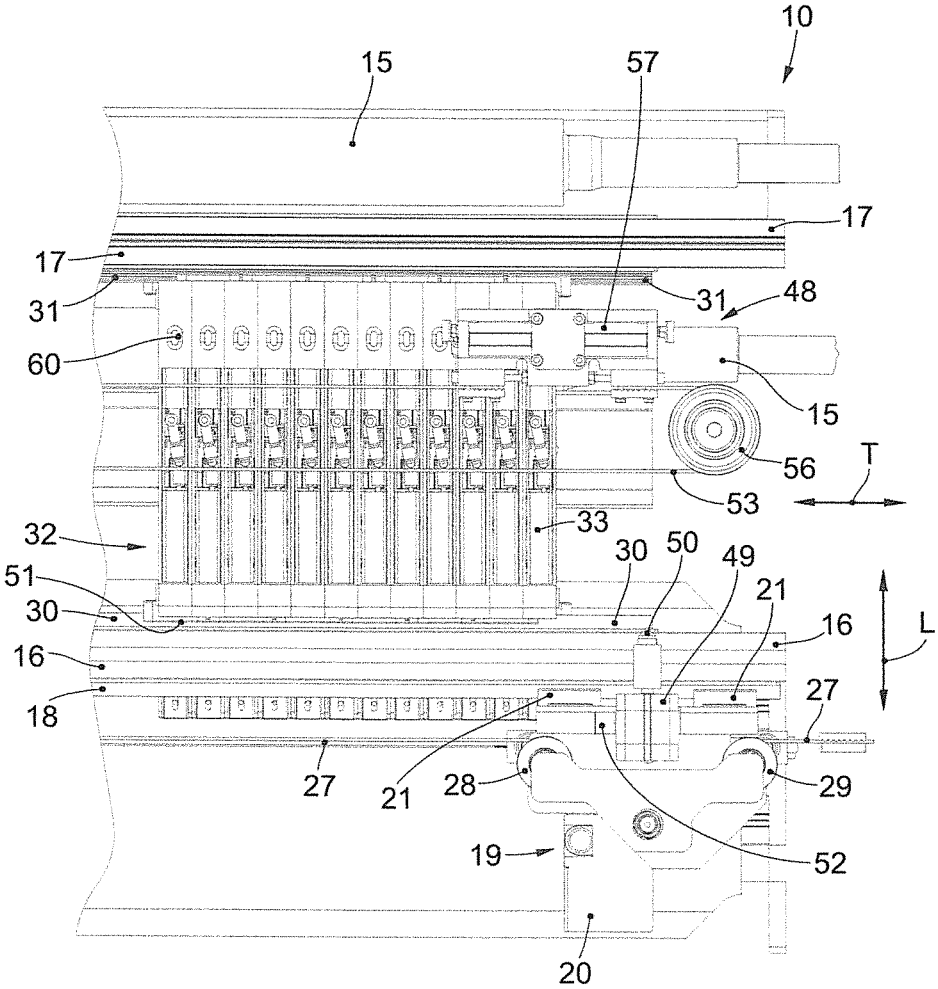
FIG. 2 is an enlarged detail of FIG. 1.

An electric motor 25 of the two-directional type is also mounted on the slider 20, for example a step or brushless motor, with a toothed pinion 26 that is constantly engaged with the teeth of a transmission belt 27 (FIGS. 1, 2, 5, 6 and 7), which is toothed only on one side and is stretched between the vertical lateral flanks 12 and 13. Two idle return pulleys 28 (FIG. 2) and 29 are mounted rotatable on the upper part of the slider 20 and are constantly in contact with the non-toothed surface of the transmission belt 27 in order to improve the contact between the toothed pinion 26 and the teeth of the transmission belt 27.

A transducer of the known type, not shown in the drawings, is associated with the electric motor 25 in order to determine the instantaneous position of the slider 20 and therefore of the transverse working head 19, with respect to the first transverse guide bar 16, in the transverse direction T, and to send corresponding electric signals to a control circuit C (FIG. 3) disposed, for example, in the lower part of the machine 10, which also controls the electric motor 25.

On the rear side of the first transverse guide bar 16 (on the right in FIG. 7) two second guide rails 30 are mounted, parallel to and in correspondence with the first guide rails 18. Moreover, on the front side of the second transverse guide bar 17 (on the left in FIG. 7) two third guide rails 31 are mounted, also parallel to and in correspondence with the first guide rails 18.

On the second and third guide rails 30 and 31 a plurality of longitudinal working heads 32 (FIGS. 1 to 7) are mounted slidingly, parallel to each other, of which, in the example shown here, there are twelve, but there can be more or fewer, as a function of the gap between the vertical lateral flanks 12 and 13 and the number of workings to be carried out at the same time on each sheet F inserted in the machine 10.

Each longitudinal working head 32 comprises a slider 33 (FIG. 7) provided with sliding elements, in this case sliding pads 34 and 35 engaged constantly with the corresponding rails 30 and 31.

Therefore, the vertical distance between the two second guide rails 30 and that between the third guide rails 31 is also sufficiently big so that the guide rails 30 and 31 are in correspondence with the upper part of each slider 33 and with the lower part of the same slider 33, in order to guarantee a secure and stable guide of the latter when it moves in the transverse direction T.

Moreover, a cutting tool 36, also consisting of a circular blade, and a creasing tool 37, also consisting of a shaped disc, are mounted on each slider 33.

The tools 36 and 37 are associated with corresponding actuators 38 and 39, for example pneumatic, suitable to selectively take them against the sheet F below, in order to make longitudinal cuts and/or creasings, that is, in the longitudinal direction L, while the sheet F is fed by the feed rolls 15 in the same longitudinal direction L.

Each slider 33 is also provided with a clamping device 40, configured to clamp the corresponding longitudinal working head 32 in the desired transverse position, with respect to the transverse guide bars 16 and 17.

Each clamping device 40 comprises a first inflatable membrane 41, disposed between the second guide rails 30, connected to a corresponding first support and inflation chamber 42, which is provided with a first compressed air supply channel 43, controlled for example by an electro valve of the known type and not shown in the drawings. Each clamping device 40 also comprises a second inflatable membrane 44, disposed between the third guide rails 31, connected to a corresponding second support and inflation chamber 45, which is provided with a second compressed air supply channel 46, which is also controlled, for example, by an electro valve of the known type and not shown in the drawings.

The two inflatable membranes 41 and 44 are made of rubber for example and, when they are selectively inflated with compressed air, act as a brake pressing with a determinate force against the corresponding flat vertical surfaces of the two transverse guide bars 16 and 17, thus keeping the corresponding slider 33 in the desired position and therefore the associated longitudinal working head 32. On the contrary, when one or more longitudinal working heads 32 are to be moved with respect to the transverse guide bars 16 and 17, in the transverse direction T, the inflatable membranes 41 and 44 are deflated, thus releasing the corresponding sliders 33.

In order to selectively move each slider 33 in the transverse direction T, positioning means are optionally provided, in this case a first transverse positioning device 47 and second transverse positioning device 48.

Please note that in the machine 10 both the transverse positioning devices 47 and 48 can be present, or, alternatively, only one or the other of the two transverse positioning devices 47 and 48.

In particular, the first transverse positioning device 47 is similar to the one described in the above cited international patent application WO-A-201 1/135433. In this case, the first transverse positioning device 47 (FIGS. 6 and 7) is mounted on the upper part of the slider 20 of the transverse working head 19 and comprises an actuator 49, of the pneumatic type for example, with a pointed peg 50 configured to selectively cooperate with a flared cavity 51 present on a flank of each slider 33 of a corresponding longitudinal working head 32.

The pointed peg 50 is therefore configured to act as a drawing element and is normally held in a retracted position, so as not to interfere with the longitudinal working heads 32. The actuator 49 remains deactivated during the working steps of the transverse working head 19, that is, cutting and/or creasing in the transverse direction T.

A photo cell 52 (FIG. 6) is mounted on the slider 20 and is able to recognize the passage of the latter in front of each longitudinal working head 32 and to send a corresponding electric signal to the control circuit C, in order to identify, with precision, the position of the slider 20 with respect to each longitudinal working head 32. Moreover, when one of the longitudinal working heads 32 is attached by the slider 20, with the photo cell 52 it is possible to precisely determine the position of the longitudinal working head 32 attached with respect to the transverse guide bars 16 and 17.

The second transverse positioning device 48 is instead mounted on the fixed frame 11 (FIG. 1), in correspondence with the rear part of the machine 10, and comprises a transmission belt 53, toothed and closed in a ring, stretched between a toothed pinion 54 of an electric motor 55 (FIG. 3), for example a step, or brushless motor, disposed in correspondence with the vertical lateral flank 12 and a return pulley 56, mounted rotatable in correspondence with the vertical lateral flank 13.

A small slider 57 is attached on the rear part of the transmission belt 53 (FIGS. 1, 6 and 7), and an actuator 58 is mounted on the small slider 57, for example of the pneumatic type, with a pointed peg 59 facing downward and configured to selectively cooperate with a flared cavity 60 present on the upper part of each slider 33 of a corresponding longitudinal working head 32.

Therefore, the pointed peg 59 is configured to act as a drawing element and is normally held in retracted position, so as not to interfere with the longitudinal working heads 32. The actuator 58 remains deactivated during the working steps of the longitudinal working heads 32, that is, cutting and/or creasing in the longitudinal direction L.

A transducer of the known type and not shown in the drawings is associated with the electric motor 55 (FIG. 3) and is able to send a corresponding electric signal to the control circuit C, in order to identify with precision the position of the small slider 57 with respect to each longitudinal working head 32 and, when one of these is attached by the small slider 57, also the position of the longitudinal working head 32 attached, with respect to the transverse guide bars 16 and 17. Alternatively, or additionally, a linear transducer can also be provided, associated with, for example, one of the two transverse guide bars 16 and 17, in order to detect the position of each longitudinal working head 32.

The functioning of the machine 10 described heretofore, which also defines the method for working a sufficiently rigid material, represented here by the sheet F, to make containers, is as follows.

Initially, the position of each longitudinal working head 32 (FIGS. 1 and 3), with respect to the vertical lateral flanks 12 and 13 and the transverse guide bars 16 and 17, is programmed, in a known manner, by the control circuit C, in order to carry out the desired longitudinal cuttings and/or the desired creasings on the sheet F (FIG. 7) disposed on the support plane P, in contact with the feed rolls 15.

The transverse workings of cutting and/or creasing on the sheet F are carried out in the known way, for example as described in the above cited international patent application WO-A-201 1/135433. In particular, the actuators 24 are selectively actuated (FIGS. 6 and 7) to take the cutting tool 22 and/or the creasing tool 23 against the sheet F below, and the electric motor 25 is driven to move the transverse working head 19 in the transverse direction L.

In order to carry out longitudinal workings of cutting and/or creasing on the sheet F, one or more longitudinal working heads 32 must first be positioned in the desired positions along the transverse guide bar 17.

Figure 6:
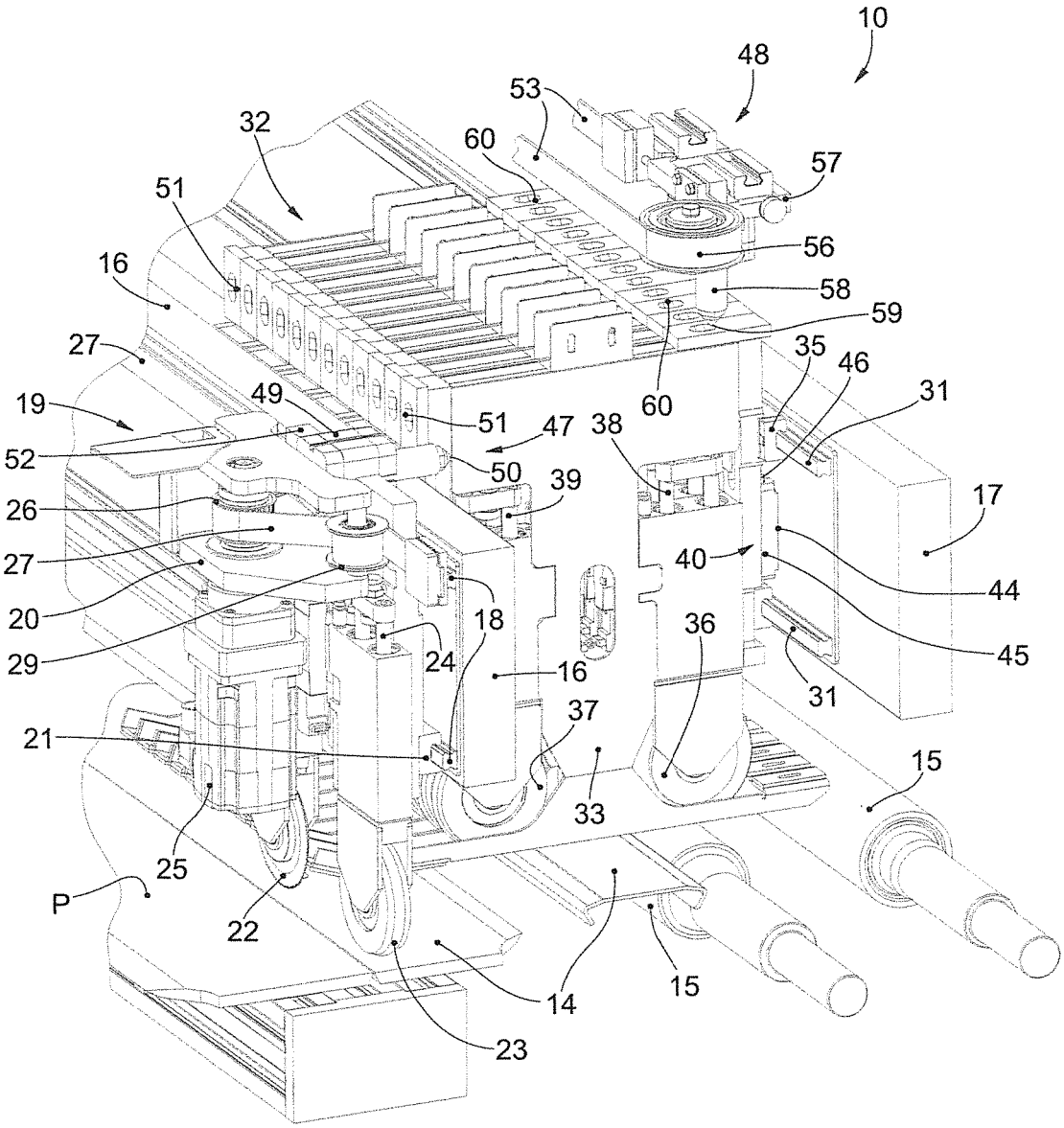
FIG. 6 is an enlarged detail of FIG. 5.

To do this, first of all the corresponding clamping devices 40 (FIG. 7) must be released, deflating the inflatable membranes 41 and 44. Each longitudinal working head 32 is then moved in the transverse direction T (FIG. 1) into the desired position, by one of the two transverse positioning devices 47 and 48 (FIGS. 6 and 7).

In particular, if the first transverse positioning device 47 is used, in the same way as described in the international patent application WO-A-201 1/135433 cited above, the positioning of each longitudinal working head 32 must be done with the tools 22 and 23 of the transverse working head 19 raised, in a non-operating position.

Figure 3:
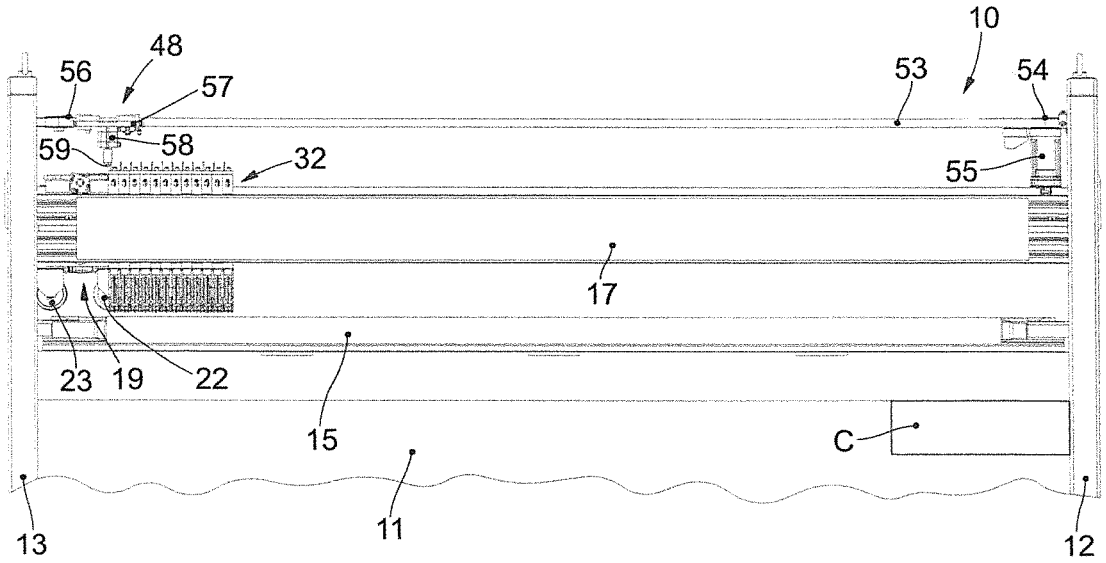
FIG. 3 is a rear view of the machine in FIG. 1.
Figure 4:
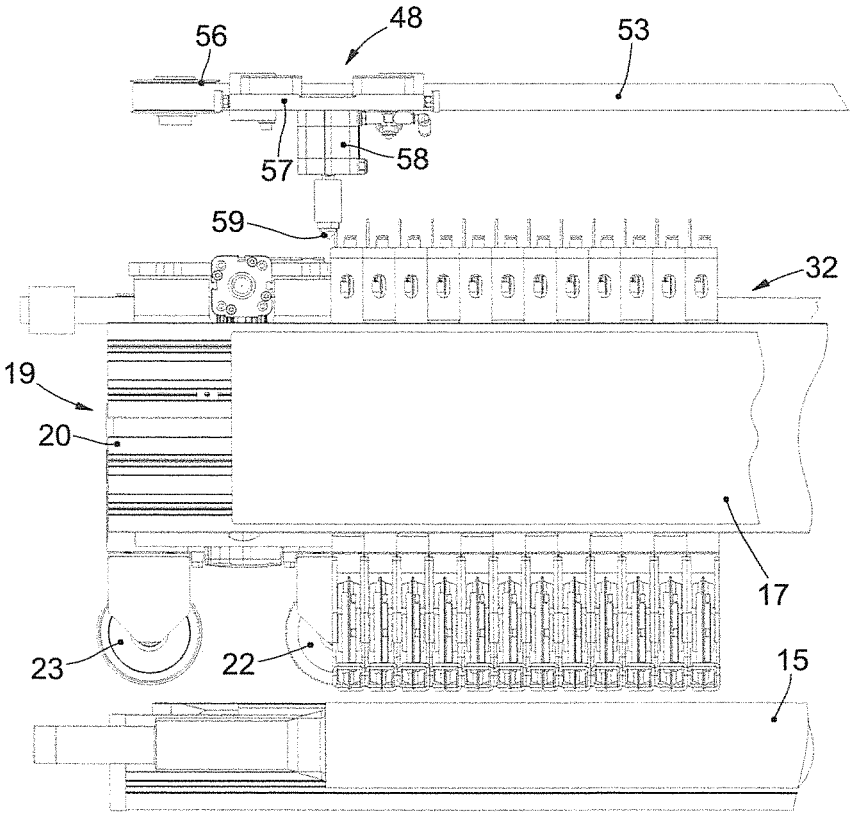
FIG. 4 is an enlarged detail of FIG. 3.

In this first case, the slider 20 is first made to perform a complete travel from the left (FIG. 1) toward the right and from the right toward the left, so that the photo cell 52 (FIG. 6) acquires the necessary information on the actual position of all the longitudinal working heads 32 and transmits it to the control circuit C (FIG. 3).

Then, in order to move a longitudinal working head 32 transversely, starting for example from the one most to the left in FIG. 1, the control circuit C (FIG. 3) commands the motor 25 (FIGS. 6 and 7) which, by means of the transmission belt 27, causes the movement of the slider 20, until the pointed peg 50 of the actuator 49 is exactly opposite the flared cavity 51 of the corresponding longitudinal working head 32. The actuator 49 is then actuated so that the pointed peg 50 is inserted precisely into the flared cavity 51 of the slider 33 of the longitudinal working head 32 selected.

The electric motor 25 is then once again commanded which, by means of the transmission belt 27, actuates the movement of the slider 20 and the slider 33 which is temporarily attached to it. This movement ends when the slider 33 and the longitudinal working head 32 associated therewith arrive in the desired transverse position, calculated by the control circuit C (FIG. 3), by means of the transducer associated with the electric motor 25.

The actuator 49 is then de-activated (FIG. 6), so that its pointed peg 50 returns to the initial retracted position. The longitudinal working head 32 selected is thus in its new, desired transverse position.

The same operation is then repeated for all the other longitudinal working heads 32 that are to be moved and positioned transversally with respect to the transverse guide bars 16 and 17.

Once all the longitudinal working heads 32 have been positioned, the clamping devices 40 are actuated, so that the two inflatable membranes 41 and 44 of each slider 33 inflate and act as a brake against the corresponding flat surfaces of the flanks of the transverse guide bars 16 and 17.

The machine 10 can therefore carry out all the cutting and/or creasing operations on the sheet F in a known manner, both transverse by means of the transverse working head 19, and also longitudinal, by means of the different longitudinal working heads 32.

If instead the second transverse positioning device 48 is used, the positioning operation of each longitudinal working head 32 can take place while the tools 22 and 23 of the transverse working head 19 are working and the latter is moving from one to the other of the two vertical lateral flanks 12 and 13.

Indeed, in this second case, to move a longitudinal working head 32 transversely, starting for example from the one most to the left in FIG. 1, the control circuit C (FIG. 3) commands the motor 55 which, by means of the transmission belt 53, causes the movement of the small slider 57, until the pointed peg 59 of the actuator 58 is exactly opposite the flared cavity 60 (FIGS. 6 and 7) of the corresponding longitudinal working head 32. The actuator 58 is then actuated so that the pointed peg 59 is inserted with precision into the flared cavity 60 of the small slider 57 of the longitudinal working head 32 selected. The electric motor 55 is then once again commanded which, by means of the transmission belt 53, actuates the movement of the small slider 57 and of the slider 33 temporarily attached thereto. This movement ends when the slider 33 and the longitudinal working head 32 associated therewith arrive in the desired transverse position, calculated by the control circuit C (FIG. 3), by means of the transducer associated to the electric motor 55.

The actuator 58 is then de-activated (FIG. 6), so that its pointed peg 59 returns into the initial retracted position. The longitudinal working head 32 selected is thus once again in its desired new transverse position.

In this second case too, the same operation is then repeated for all the other longitudinal working heads 32 that are to be moved and positioned transversely with respect to the transverse guide bars 16 and 17.

Once all the working heads 32 are positioned, the clamping devices 40 are actuated, so that the two inflatable membranes 41 and 44 of each slider 33 inflate and act as brakes against the corresponding flat surfaces of the flanks of the transverse guide bars 16 and 17.

The machine 10 can therefore carry out all the longitudinal cutting and/or creasing operations on the sheet F, using the different longitudinal working heads 32, while the transverse ones can also continue to be carried out, by means of the transverse working head 19.

Please note that, irrespective of which transverse positioning device 47 or 48 is used, the longitudinal working heads 32 are however always guided with precision and reliability in the transverse direction T, thanks to the two transverse guide bars 16 and 17 disposed on opposite sides with respect to the different sliders 33 and to the big vertical distance between the individual rails of each pair of second and third rails 30 and 31.

Moreover, also each clamping device 40, with the membranes 41 and 44 disposed between the second rails 30 and respectively between the third rails 31, guarantees and ensures a precise and stable positioning of each longitudinal working head 32 in the desired position.

It is clear that modifications and/or additions of parts and/or steps may be made to the machine 10 and corresponding method as described heretofore, without departing from the field and scope of the present invention.

It is also clear that, although the present invention has been described with reference to some specific examples, a person of skill in the art shall certainly be able to achieve many other equivalent forms of the machine and/or method for working a sufficiently rigid material, suitable to make containers, having the characteristics as set forth in the claims and hence all coming within the field of protection defined thereby.

The invention claimed is:

1. A machine to carry out workings on a sheet of a material suitable to make containers, comprising:

a fixed frame that defines a support plane for said sheet;

a feeder configured to feed said sheet in a first longitudinal direction along said support plane;

at least a first transverse guide member disposed in a transverse direction, substantially perpendicular to said first longitudinal direction;

a transverse working head, provided with a first cutting tool and/or a first creasing tool and guided by said first transverse guide member, to selectively carry out transverse cuttings and/or creasings on said sheet;

one or more longitudinal working heads, each provided with a second cutting tool and/or a second creasing tool to selectively carry out longitudinal cuttings and/or creasings on said sheet, and each selectively positionable in a desired transverse position, guided by at least a second transverse guide member parallel to said first transverse guide member, to carry out longitudinal cuttings and/or creasings on said sheet; and a positioning mechanism, configured to cooperate with each of said longitudinal workings heads in order to position it selectively in said desired transverse position, wherein said positioning mechanism comprises a first transverse positioning device and a second transverse positioning device, wherein said first transverse positioning device is mounted on said transverse working head, wherein said second transverse positioning device is mounted on said fixed frame and movable in the transverse direction to be selectively engagable with any one of the longitudinal working heads, wherein each of said first transverse positioning device and said second transverse positioning device is configured to position each of said longitudinal working heads along said transverse direction, and wherein each of said longitudinal working heads is disposed between said first transverse guide member and said second transverse guide member and comprises sliding elements configured to cooperate slidingly with both said first transverse guide member and said second transverse guide member.

2. The machine as in claim 1, wherein said transverse working head comprises a first slider, and wherein said first transverse guide member comprises a first pair of guide rails distanced vertically so as to cooperate one with an upper part of said first slider and another with a lower part of said first slider.

3. The machine as in claim 2, wherein said first transverse guide member comprises a bar with two vertical lateral surfaces, on a first of which said first pair of guide rails is attached and on a second of which said second pair of guide rails is attached.

4. The machine as in claim 3, wherein said second slider is provided with a clamping device, configured to selectively clamp the corresponding longitudinal working head in the desired transverse position, with respect to at least one of said transverse guide members.

5. The machine as in claim 1, wherein each of said longitudinal working heads comprises a second slider, and wherein said first transverse guide member comprises a second pair of guide rails distanced vertically so as to cooperate one with an upper part of said second slider and another with a lower part of said second slider.

6. The machine as in claim 5, wherein each second transverse guide member comprises a third pair of guide rails, aligned vertically with said second pair of guide rails, so as to also cooperate one with an upper part of said second slider and another with a lower part of said slider, but on the opposite side of the latter with respect to said second pair of guide rails.

7. The machine as in claim 5, wherein said second slider is provided with a clamping device, configured to selectively clamp the corresponding longitudinal working head in the desired transverse position, with respect to at least one of said transverse guide members.

8. The machine as in claim 7, wherein said clamping device comprises at least a first inflatable membrane, disposed between said second pair of guide rails and connected to a corresponding first support and inflation chamber provided with a first compressed air supply channel.

9. The machine as in claim 8, wherein said clamping device also comprises a second inflatable membrane, disposed between said third pair of guide rails and connected to a corresponding second support and inflation chamber provided with a second compressed air supply channel.

10. The machine as in claim 5, wherein said first transverse guide member comprises a bar with two vertical lateral surfaces, on a first of which said first pair of guide rails is attached and on a second of which said second pair of guide rails is attached.

11. The machine as in claim 1, wherein said transverse working head comprises a first slider, and wherein said first transverse guide member comprises a first pair of guide rails distanced vertically so as to cooperate one with an upper part of said first slider and another with a lower part of said first slider.

12. The machine as in claim 1, wherein each of said longitudinal working heads comprises a second slider, and wherein said first transverse guide member comprises a second pair of guide rails distanced vertically so as to cooperate one with an upper part of said second slider and another with a lower part of said second slider.

13. The machine as in claim 1, wherein said second transverse positioning device is located between the transverse guide members.

14. The machine as in claim 1, wherein said second transverse positioning device is located above the longitudinal working heads.

15. The machine as in claim 1, wherein said second transverse positioning device is movable relative to the longitudinal working heads.

16. A method to make workings on a sheet of a material suitable to make containers, comprising the steps of:

feeding said sheet in a first longitudinal direction;

carrying out transverse cuts and/or creasings by means of a transverse working head, provided with a first cutting tool and/or a first creasing tool guided by first transverse guide member and mobile in a first transverse direction, substantially perpendicular to said first longitudinal direction;

carrying out longitudinal cuts and/or creasings by means of longitudinal working heads, each provided with a second cutting tool and/or a second creasing tool and each selectively positionable in a desired position along said first transverse direction and guided by at least a second transverse guide member parallel to said first transverse guide member;

selectively moving any one of the longitudinal working heads in said desired transverse position by moving a positioning device mounted on said fixed frame in the transverse direction and selectively engaging the positioning device with any one of the longitudinal heads even while said transverse working head is carrying out said transverse cuts and/or said transverse creasings, wherein each longitudinal working head is disposed between said first transverse guide member and said second transverse guide member.

17. The method as in claim 16, further comprising moving said second transverse positioning device relative to the longitudinal working heads.

18. The method as in claim 16, further comprising moving the second transverse positioning device to be aligned with one of the longitudinal working heads.

* * * * *